US005151739A

United States Patent [19]

Hediger

[11] Patent Number: 5,151,739

[45] Date of Patent: Sep. 29, 1992

[54] DEVELOPMENT APPARATUS AND IMPROVED AUGER DEVICE FOR USE THEREIN

[75] Inventor: Edwin A. Hediger, Fairport, N.Y.

[73] Assignee: Eastman Kodak Company, Rochester, N.Y.

[21] Appl. No.: 737,304

[22] Filed: Jul. 29, 1991

[51] Int. Cl.[5] ..... G03G 15/06

[52] U.S. Cl. ..... 355/245; 222/DIG. 1; 366/301

[58] Field of Search ..... 118/653; 355/245, 246; 366/297, 301; 222/238, DIG. 1; 241/260.1

[56] References Cited

U.S. PATENT DOCUMENTS

| | | | |
|---|---|---|---|
| 4,546,060 | 9/1985 | Miskinis et al. | 430/108 |
| 4,633,807 | 1/1987 | Jacobs | 118/657 |
| 4,634,286 | 1/1987 | Pike | 366/320 |
| 4,707,107 | 10/1987 | Joseph | 355/253 |
| 4,974,023 | 11/1990 | Aimoto et al. | 355/245 |
| 4,980,724 | 12/1990 | Tanaka | 355/245 |
| 4,982,691 | 1/1991 | Asanuma et al. | 118/658 |
| 4,996,565 | 2/1991 | Herley | 355/245 |
| 5,012,286 | 4/1991 | Kawano et al. | 355/246 |
| 5,025,287 | 6/1991 | Hilbert | 355/245 |

*Primary Examiner*—A. T. Grimley
*Assistant Examiner*—P. J. Stanzione
*Attorney, Agent, or Firm*—Tallam I. Nguti

[57] ABSTRACT

A dual augar development apparatus for use in an electrostatographic reproduction machine such as copier or printer, includes a pair of identical single piece auger devices mounted therein and each having a shaft and a plurality of integrally formed blade members so as to require no blade-member-to-shaft-assembly. A last blade member includes a cross-transfer member connected thereto and integrally formed therewith. The blade members are semi-elliptical and form a single straight row of such members on the shaft. The row is aligned circumferentially so as to result in intermittent augering of developer material in the development apparatus.

15 Claims, 2 Drawing Sheets 12
30
42
60
54
D
57
48
99B
72
69
68
49
66
99A
70
47
46
44
S
62
50
64
52
58
56
59
T1

10
35
36
DD
40
T1
20
22
13
26
24
AA
34
16
15
CC
33
11
T1
14
D
BB
30
12

DEVELOPMENT APPARATUS AND IMPROVED AUGER DEVICE FOR USE THEREIN

TECHNICAL FIELD

This invention relates to development apparatus in electrostatographic reproduction machines such as copiers and printers for electrostatically developing latent images with developer material. More particularly, this invention relates to such a development apparatus that includes an improved auger device for mixing and charging the developer material.

BACKGROUND ART

It is well known to use toner particles stored within a development apparatus in an electrostatographic reproduction machine, such as a copier or printer, to develop electrostatically formed latent images on an image-bearing member. The toner particles may be stored as such alone or as a component of a two-component developmer material, the second component being magnetic carrier particles.

Typically, the development apparatus so used is elongate front-to-back, and is utilized to store, move and mix the developer material. Where two component developer material is employed, moving, mixing and feeding the developer material as such, triboelectrically and appropriately charges the toner and carrier particles therein. Additionally, the development apparatus also brings the developer material into applying relationship with the images to be developed so that the charged toner particles contained in such developer material are attracted to such images. Such development apparatus are disclosed, for example, in commonly assigned U.S. Pat. Nos. 5,025,287; 4,633,807; 4,634,286; and 4,707,107.

The quality of images developed with charged toner particles as above, depends significantly on the effectiveness and reliability of the development apparatus in triboelectrically charging the toner and carrier particles, and in consistently maintaining desirably high end to end concentration levels of toner particles even when new toner particles are replenished or added at one of such ends. As such, improvements in devices for moving and mixing developer material are very important and welcome towards improving the quality and reliability of electrostatographic image development.

It has been found, however, that development apparatus which include conventional and other types of developer material moving and mixing devices, for example, ribbon blenders, helixes and stemmed paddle augers, require jointing and assembly, and hence are likely to experience assembled component failure, thus resulting in occasional and unpredictable moving or pumping of developer material within the development apparatus. Such uneven pumping or movement of developer material is often accompanied by excessive dusting within the development apparatus, by inadequate mixing and, hence, by inadequate charging of the toner and carrier particles therein. More importantly, such uneven movement or pumping of developer material results in dead spots, in uneven front-to-back accumulation, and in uneven depletion of toner particles across the length of the development apparatus. The end result, of course, is occasional poor and unreliable quality development of images.

These shortcomings of the above types of development apparatus have been found to be especially true when the developer material is of the type disclosed in commonly assigned U.S. Pat. No. 4,546,060 issued Oct. 8, 1985 in the names of Miskinis et al. Such developer material as disclosed is comprised of insulative toner particles and of carrier particles exhibiting hard magnetic properties.

SUMMARY OF THE INVENTION

It is an object of the present invention to provide an electrostatographic development apparatus that produces desirably high and reliable quality image development.

It is another object of the present invention to provide such a development apparatus that is capable of relatively high rates of developer material movement with a minimum of dead spots, and with substantial shearing and cross-mixing.

It is a further object of the present invention to provide such a development apparatus which includes a mixing device that is not subject to assembly or jointing failure, and is thus relatively very reliable.

In accordance with the present invention, a single piece auger device is provided for use in a development apparatus of an electrostatographic reproduction machine to move, mix and triboelectrically charge developer material. The single piece auger device comprises a rigid round shaft having first and second ends for mounting in a development apparatus housing. The single piece auger device also comprises a plurality of radially extending blade members which are spaced axially on the shaft and are each slanted relative to the axis of the shaft. The blade members are formed integrally with the shaft so as to require no blade-member-to-shaft assembly. The plurality of blade members includes a first blade member adjacent the first end of the shaft, and a last blade member towards the second end of the shaft. The single piece auger device further comprises a radially extending cross-transfer member formed integrally with and at a transverse direction relative to the last blade member. The cross-transfer member in order to eliminate any dead spots in developer material movement is formed connected to the last blade member and extends therefrom longitudinally relative to the shaft to a mounting point on the shaft adjacent the second end thereof.

BRIEF DESCRIPTION OF THE DRAWINGS

In the description of the invention presented below, reference is made to the drawings in which.

DETAILED DESCRIPTION OF THE PREFERRED EMBODIMENT

Because electrostatographic reproduction apparatus or machines are well known, the present description will be directed in particular to elements forming part of or cooperating more directly with the present invention. Elements not specifically shown or described herein are selectable from those known in the prior art.

Figure 1:
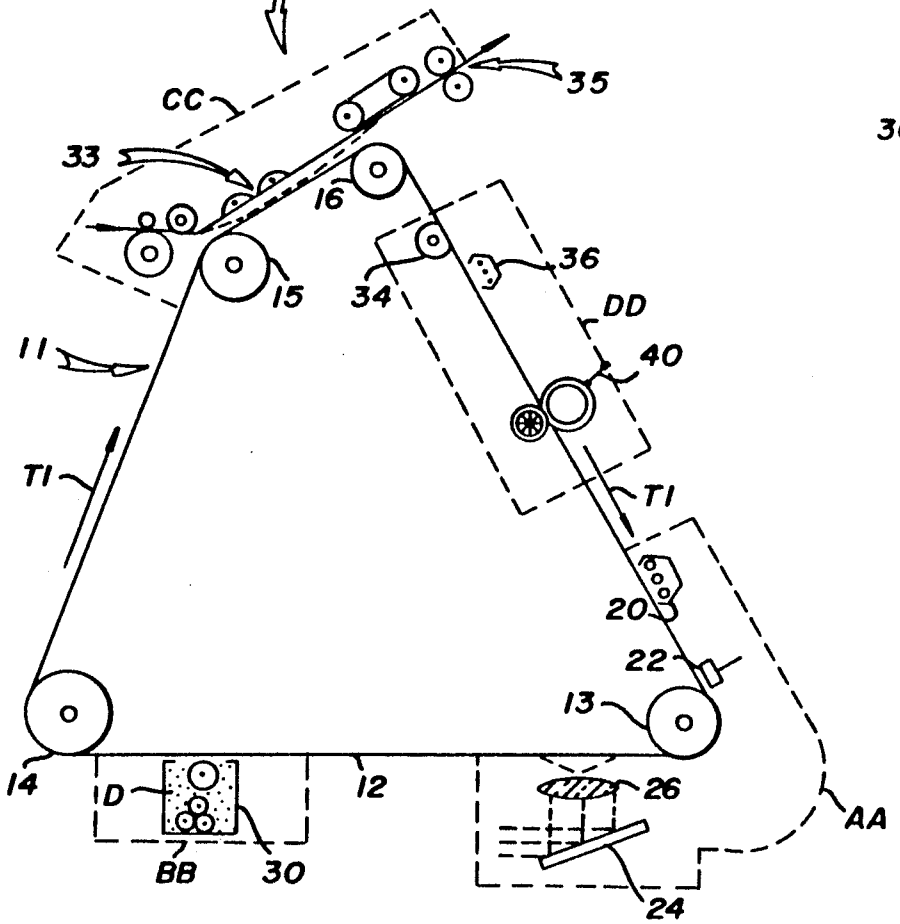
FIG. 1 is a schematic of an electrostatographic reproduction machine such as a copier or printer including the development apparatus of the present invention.

Referring now to FIG. 1, an electrostatographic reproduction apparatus or machine such as an optical copier is shown generally as 10. The apparatus 10, as shown, includes an image-bearing member 11 which is an endless flexible photoconductive belt that has a frontside image-bearing surface 12. Although the member 11 is shown as an endless flexible web trained about the series of rollers 13–16, it should be understood that an image-bearing member in the form of a rigid drum can also be used. The member 11, as shown, is trained about the series of rollers 13–16 for movement in the direction, for example, of the arrow T1. One of the rollers, such as the roller 13, can be a drive roller for repeatedly moving the member 11 through a series of electrostatographic process stages shown, for example, as AA, BB, CC and DD.

As shown in FIG. 1, clean and charge-free portions of the image-bearing member 11 initially move through the stage AA where electrostatic charges and/or light, are used in one manner or another (as is well known in the art) to electrostatically form, on the surface 12, latent images of an original document. Typically, the stage AA includes components such as a primary charger 20 or other charge depositing component (not shown). The latent image of an original can thus be formed electrostatically on the image-bearing surface 12, for example, by first uniformly charging the surface 12 to a suitable potential using the primary charger 20, and then imagewise discharging portions of such surface using, for example, an electronic printhead 22 or the like, and/or an optical system as shown partially. A typical optical system includes a light source (not shown) that illuminates a document sheet. The light rays reflected by a mirror such as 24 can then be reflected through a lens 26, and onto the surface 12 for such optical imaging.

The imaged portion of the image-bearing surface 12 of member 11 next moves to the stage BB where the latent image thereon is developed, that is, made visible, with charged particles of toner. Stage BB therefore includes a development apparatus, such as the development apparatus of the present invention, shown generally as 30. The development apparatus 30 of the present invention (to be described in detail below) contains magnetic developer material D, for example a two-component magnetic developer material that is comprised of magnetic carrier particles and charged toner particles. The magnetic developer material is used therein for developing the latent images on the surface 12 of member 11. During such image development, the charged toner particles in the developer material D transfer to the image-bearing surface 12, and there adhere to the latent electrostatically formed image thereon, thereby making the image visible.

After such development, the portion of the image-bearing member 11 carrying the toner image thereon then moves to the stage CC. The stage CC, as shown, includes an image transfer station 33 where the visible toner image on the surface 12 is transferred to a suitable receiver sheet, such as a sheet of plain paper, which is fed in registration to the station 33 along a sheet travel path. After such image transfer, the copy sheet then travels to a fusing station 35, as shown, where the toner image is permanently fused to the receiver sheet to form a hard copy.

Meanwhile, the used portion of member 11, from which the toner image was transferred, moves on towards the initial stage AA to again begin another imaging cycle. To ensure continued production of high quality hard copies during subsequent cycles of the above imaging process, each such used portion of the surface 12 must be cleaned before it is again reused. Such cleaning effectively removes any residual charges and residual particles remaining on the surface 12 following image transfer. Accordingly, such cleaning is carried out at the stage DD where residual charges are removed by a discharge lamp 34 and/or neutralized by a corona charger 36, for example, and residual particles are removed by a cleaning apparatus shown, for example, as 40.

Figure 2:
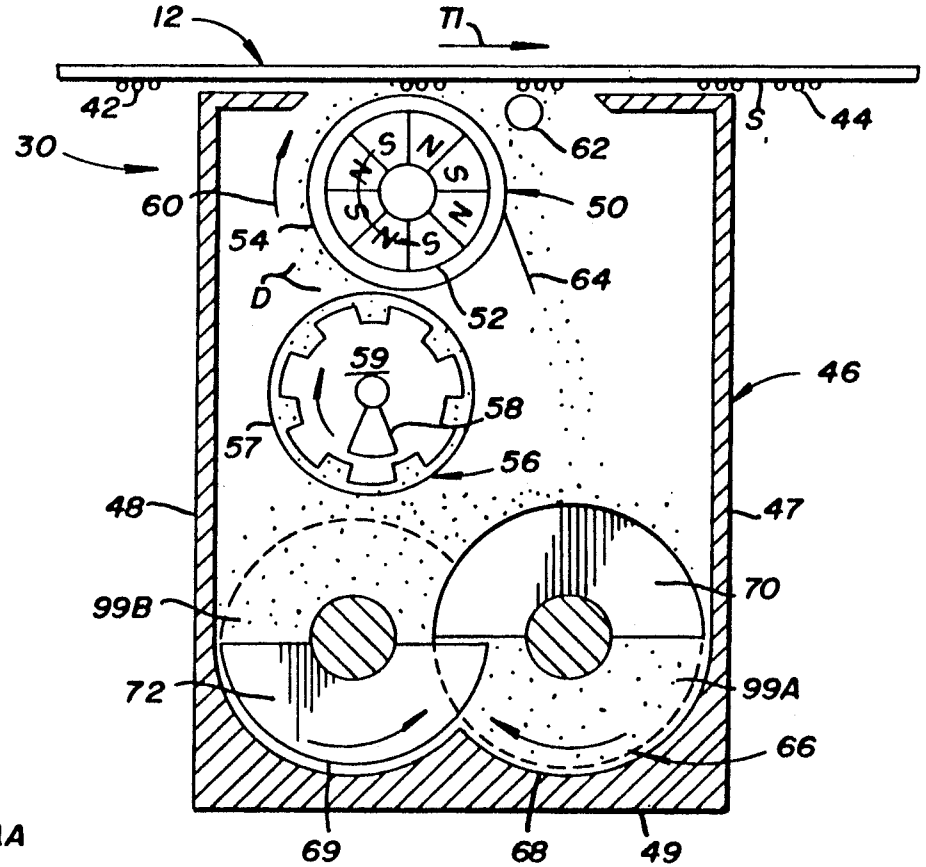
FIG. 2 is an enlarged end section of the development apparatus of the present invention incorporating the single piece auger device of the present invention.

Referring now to FIG. 2 of the drawings, the development apparatus of the present invention is generally designated 30. Development apparatus 30 is adapted to store, mix and supply a quantity of marking particles, such as charged toner particles contained in the magnetic developer material D, for developing latent electrostatographic images 42 formed as above on the image-bearing surface 12 of the image-bearing member 11. During development, the charged toner particles in the magnetic development material D are attracted to electrostatic latent images 42, thus forming toner or developed images illustrated as 44.

The development apparatus 30 has an elongate housing 46 which includes a top wall having an opening therein, upright end walls (not shown), first and second side walls 47, 48 and a bottom wall 49. A magnetic development roller 50 located in the upper portion of housing 46 extends substantially the entire length (end wall-to-end wall) of the housing. The development roller 50 is located within the housing 46 so that it is within the opening in the top wall, and so that it projects slightly therethrough. The development apparatus 30 is mounted within the copier or printer 10 (FIG. 1) so that the development roller 50 is adjacent and spaced only a small distance from the image-bearing surface 12 of the member 11. The development roller 50 preferably includes a magnetic core 52 comprised of a series of longitudinally extending, alternating N and S pole magnets arranged as shown. The core 52 is supported at its ends by conventional means, and is driven rotatably, for example, in the counterclockwise direction by a drive motor (not shown). The development roller 50 also includes a non-magnetic shell 54 that may be concentric with the core 52, and that is similarly supported. As such, the shell 54 may be stationary or also rotatable.

The development apparatus 30 further includes a feed roller 56 located below the development roller 50 for feeding developer material D onto the surface of the non-magnetic shell 54. The feed roller 56 includes a stationary shell 57 and a stationary magnet 58 for attracting magnetic developer material into roller 56 through a first opening at the bottom thereof for movement mechanically therewithin by a rotatable fluted core 59. The developer material moved thus is attracted out of the feed roller 56 through another opening at the top thereof and onto the surface of the shell 54 by the magnetic influence of the core 52. Appropriate rotation of the core 52 and shell 54 of the development roller 50 as is well known will then move the developer material D attracted thereonto, in the direction of the arrow 60 for electrostatically developing the images 42 on the surface 12.

During such image development, appropriately charged toner particles, contained in a development zone together with oppositely charged magnetic carrier particles in the developer material D, are desirably attracted onto the latent electrostatic images 42 on the surface 12 thereby forming the toner or developed images 44. The toner images 44 subsequently can be transferred, if necessary, onto a suitable receiver for fusing in order to form a fused or permanent copy thereof.

To improve the quality of such a fused copy, the development apparatus 30 includes a scavenging device 62 for recovering, from the image-bearing surface 12, any charged magnetic carrier particles undesirably also attracted to the latent images 42 during image development, as above. The development apparatus 30 also includes a skive mechanism 64 for removing spent developer material from the development roller 50 before it again attracts fresh developer from the feed roller 56 for subsequent image development.

The quality of image development with charged toner particles, as above, depends even more significantly on a number of factors, including particularly the charge values or levels of the toner and carrier particles of the developer material D, as well as, on the level and uniformity of the concentration of such charged toner particles available throughout the elongate development apparatus. As is well known, these quality factors are directly determined by the ability and effectiveness of the development apparatus 30 (i) to cause desirable triboelectric charging of the toner and carrier particles by moving and mixing the developer material, and (ii) to achieve and maintain even front-to-back, and side-to-side movement, mixing, and accumulation of developer material within the sump portion thereof. Such ability and effectiveness of the development apparatus 30 should hold true even when, given the depletion of toner particles through image development, fresh toner particles are occasionally added thereto, for example, to the center or at one end of the sump portion. Following such addition, the fresh toner particles must of course be quickly and effectively moved and mixed with the low toner concentration developer material therein, in order to quickly achieve desirable high and uniform toner particle charge and concentration levels throughout the elongate development apparatus. Such levels, as is well known, are very necessary for high and reliable quality image development.

Accordingly for achieving such high and reliable quality image development, the development apparatus 30 includes a sump portion 66 consisting of a pair of side-by-side, parallel, recessed cylindrical sections 68 and 69 for holding a supply of developer material D. The sump sections 68, 69 are located so that they partially form an overlapping segment therebetween that has a very low bottom intersection point as close as possible to bottom of the sump 66. The development apparatus 30 then includes a pair of rotatable first and second single piece auger devices 70, 72, which are mounted side-by-side and parallel to each other within the first and second recessed sections 68, 69 respectively for moving, mixing and thereby triboelectrically charging the developer material D. The center to center distance between the recesses 68, 69 is substantially equal to the radius of one of the auger devices 70, 72 plus a clearance of 0.020 to 0.050 of an inch. As mounted, the auger devices 70, 72 are counter rotated as shown synchronously, and therefore additionally function to move the charged developer material D upwards from the sump portion 66 into transfer relationship with the feed roller 56. The auger devices 70, 72 also serve to remix spent developer removed from the surface of the development roller 50 by the skive 64.

Figure 3:
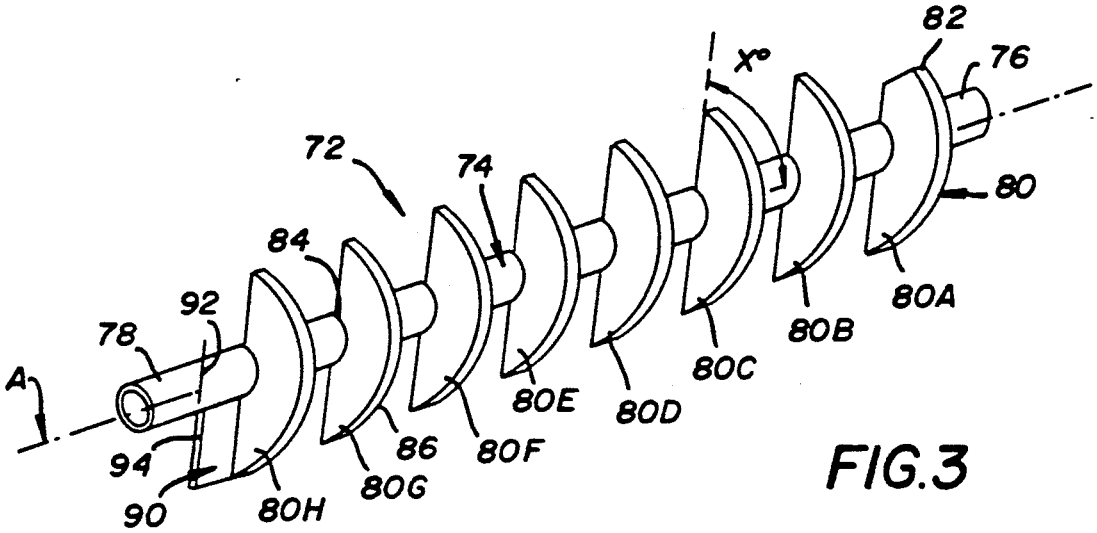
FIG. 3 is a perspective illustration of the single piece auger device of the present invention.

Referring now to FIG. 3, one of the single piece auger devices, for example the second one 72 thereof (FIG. 2) is illustrated in detail. Since both the first and second auger devices 70, 72 are identical structurally, only one of them (the second one 72) will be described here in detail. As shown, the single piece auger device 72 comprises a rigid round shaft 74, which is made for example of zinc, aluminum or magnesium, or of a thermoplastic material. The single piece auger device 72 has first and second ends 76, 78 each suitable for mounting in an end wall of the development housing 46. The shaft 74 as formed may be hollow so as to be suitable for use with a metallic solid insert therethrough for additional support.

The auger device 72 also comprises a plurality 80 of radially extending blade members shown as 80A, 80B, 80C, 80D, 80E, 80F, 80G and 80H for moving developer material in a generally axial or longitudinal direction relative to the shaft 74. The actual number of blade members is of course dependent on the spacing pitch thereof, and on the overall length of each auger device itself. In the present invention, in order to increase the reliability of the auger device 72, the plurality 80 of blade members is formed, that is molded or die casted integrally as one piece with the shaft 74 so as to require no blade-member-to-shaft assembly. As such, the likelihood of part or component failure due to part-to-part assembly or jointing is substantially eliminated. The blades 80A, 80B, 80C, 80D, 80E, 80F, 80G, and 80H are accordingly made from the same material as the shaft 74. The single piece auger device, as such, can be formed for example by any one of a number of well known molding processes including casting.

Still referring to FIG. 3, the blade members 80A, 80B, 80C, 80D, 80E, 80F, 80G and 80H form a single longitudinally or axially extending row on the shaft 74. The row, as shown, is straight and is aligned circumferentially with respect to the shaft 74. Each blade member 80A to 80H is flat and is formed slantingly at a developer material moving attack angle X° of less than 90° with respect to the longitudinal axis A of the shaft 74. The angle X° preferably should be in the range of 30° to 60°. The plurality 80 of the blade members are spaced axially at half pitch, and includes a first blade member shown as 80A which has a wall scraping edge 82, and which is formed adjacent the first end 76 of the shaft 74. The scraping edge 82 is substantially perpendicular to the axis A of the shaft, and is thus suitable for effectively scraping an end wall of the development apparatus 30. The plurality 80 of blade members also has a last blade member shown as 80H which is formed at the very end of the row of blade members towards the second end 78 of shaft 74.

As further shown, each blade member 80A to 80H is formed as a stemless semi-elliptical sector that has an inside arc 84 and an outer arc 86. The inside arc 84 therefore is formed without a stem, and is connected directly to the shaft 74 for preventing what can otherwise be a dead region of developer material immediately adjacent the circumference of the shaft 74 as can happen in the case of blade members that are mounted on stems or posts. The inside arc 84, as shown, extends slantingly approximately 180° about the circumference of the shaft 74, and therefore has a radius of curvature that is slightly greater than that of shaft 74. The outer arc 86 fans out, and as connected to the inner arc 84 follows the slant thereof, and thus has a radius of curvature that is relatively greater than that of the inner arc 84. As a consequence, the row of blade members 80A to 80H extends transversely and substantially across the shaft 74 in a manner simulating a half of a helix.

The single piece auger device, for example 72, further includes a cross-transfer member 90 for moving developer material in a radial direction with respect to the shaft 74. The cross-transfer member 90 is formed of the same material as, and integrally molded with, the last blade member 80H. As shown, cross-transfer member 90 which is radially coextensive with the last blade member 80H, is formed connected to such last blade member, and preferably extends 0.25 to 0.50 of an inch axially or longitudinally (relative to the shaft 74) from such last blade member 80H to a point 92 adjacent the second end 78 of the shaft 74. The point 92, for example, is where the inside of a development apparatus end wall would be aligned when the auger device 72 is mounted therein for operation. Cross-transfer member 90 therefore appropriately includes an end wall scraping edge 94 that as mounted will be parallel to, and scrape developer material from such an end wall at the point 92. Connected to the last blade member 80H as such, the cross-transfer member 90 therefore effectively functions to directly transfer the flow of the developer material from a longitudinal direction over to a radial direction of the shaft 74, thus eliminating dead spots that otherwise would be associated with such transfer.

Figure 4:
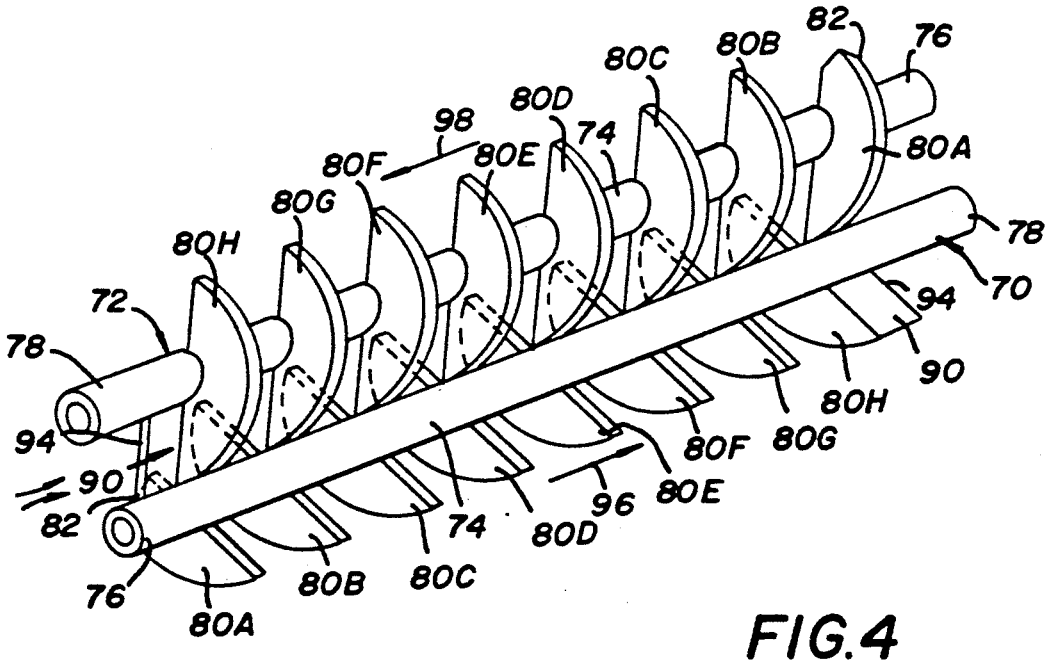
FIG. 4 is a perspective illustration of first and second single piece auger devices, of the present invention in a dual intermeshing auger mixing mode.

Referring now to FIGS. 2 and 4, the first and second single piece auger devices 70, 72 are shown in an arrangement or mode as they would appear mounted in the parallel recessed sections 68, 69 of the sump portion 66 of a development apparatus 30. As shown, the first and second auger devices 70, 72, respectively are mounted oppositely with respect to the first and second ends 76, 78 thereof, and approximately 180° out of phase, within the development apparatus housing 46 (FIG. 2). As mounted oppositely, the first shaft end 76 of the first auger device 70 is to the front end (that is, to the left of FIG. 4) of a development apparatus housing, and the second shaft end 78 thereof is to the back end (that is, to the right of FIG. 4) of such a housing. The second auger device 72 as shown is mounted oppositely relative to the first auger device 70 with respect to such front and back ends of such housing. The auger devices 70, 72 however are mounted such that the blade members of the one auger device are staggered axially with respect to those of the other auger device so as to avoid interference of such blade members when in an intermeshing or interleaving arrangement. The cross-transfer members 90 extend from the last blade member towards the second end of the respective shaft, and hence away from the intermeshing of the staggered blade members. The 180° out-of-phase mounting means that (as shown) when the row of blade members 80A to 80H of the first auger device 70 are within the top half of the sump section 68, the row of blade members 80A to 80H of the second auger device 72 (running in the opposite direction) will be within the bottom half shown as 99A (FIG. 2) of the adjacent sump section 69, and vice versa.

As mounted and rotated, the first auger device 70 will move developer material in an axial or longitudinal left-to-right (FIG. 4) direction from the first shaft end 76 thereof towards the second shaft end 78 as shown by the arrow 96 (FIG. 4). In FIG. 2, such movement will be into the plane of the sheet. At the same time, the second auger device 72 will similarly move developer material in the opposite direction as shown for example by the arrow 98 (FIG. 4).

Still referring to FIGS. 2 and 4, one unique feature of the development apparatus of the present invention is a circumferentially intermittent movement of developer material in the longitudinal direction about the shaft of each auger device 70, 72. Such intermittent movement is caused by the single row, half-helix arrangement of the blade members 80A to 80H of each auger device. Such an arrangement means that during a time period for example Ta when the row of blade members of auger device 70 are rotating for example through the top half of the sump section 68 (FIG. 2), the blade members will cause developer material in such top half to move longitudinally as described above. Uniquely, however, developer material within the bottom portion 99A of the same sump section 68 will not experience longitudinal movement during such a time period Ta. There is, therefore, a longitudinal shearing or separation between developer material in top half, and bottom half 99A, of the sump section 68. This same shearing is true with respect to the second auger device 72 between the bottom half and the top half 99B, of adjacent sump section 69.

It is, of course, understood that longitudinal movement of developer material in each sump section is caused mainly by the action of the single rotating row of blade members 80A to 80H of the respective auger device. Accordingly, such longitudinal movement from one to the other of the first and second shaft ends 76, 78 of each auger device 70, 72 occurs only intermittently around the generally cylindrical sump section 68, 69 as the row of blade members of each auger device is being rotated therethrough. Because the blade members 80A to 80H are stemless, each blade member provides a full face action in pushing developer material, thereby assuring that a substantial volume of such material can be moved at a great rate and quickly despite the otherwise advantageous but intermittent material shearing action of the blade members.

As further shown, the size of the blade members 80A to 80H of the auger devices 70, 72 are such that as mounted within the sump overlapping sections 68, 69, the staggered blade members 80A to 80H of the one device will significantly interleave with those of the other device. Such interleaving given the 180° out-of-phase arrangement, and the intermittent longitudinal flow action described above, results additionally in vastly improved side-to-side (47-to-48 FIG. 2) shearing and mixing. This is because when the blade members of the first auger device 70 are at the bottom (FIG. 4) for example of sump section 68, and are interleaving upwards therefrom, they are doing so through developer material which is at the bottom half sump section 69 and is just sitting or is temporarily not being moved longitudinally. The result is substantial cross or side-to-side shearing and mixing into such developer material. Accordingly, the intermeshing single piece auger devices 70, 72 are effectively suitable for producing end to end axial developer material shearing and flow within the sump sections 68, 69. Additionally, they produce crosswise back-and-forth side-to-side shearing and mixing, as well as continuous on-center upward feeding movement of developer material due in part to a centrifugal action from the rotating auger devices.

Furthermore, as mounted and rotated, the single piece auger devices 70, 72 also achieve effective cross-transfer of developer material from one to the other of the sump sections 68, 69. Such cross-transfer preferably should be delayed as long as possible between the ends in order to provide full and extended circulation of developer material within the development apparatus housing. This is especially preferable where fresh replenishment toner particles are added to a single point for example at one end within one of the sump sections 68, 69 and therefore must be effectively moved and mixed therein in order to achieve desired triboelectric charge and toner concentration levels. Accordingly, each auger device 70, 72 includes only a single cross-transfer member 90 that is located at the very downstream or second end of each of the auger devices relative to the direction of axial developer material movement. As located connected to the last blade member 80H of each auger device, the cross transfer member effectively eliminates what would otherwise be a material movement dead spot in the shift from a longitudinal to a radial movement at such end.

As can be seen, a single piece auger device which can be formed from a single material such as plastic is provided with a mountable round shaft and a single straight row of semi-elliptical half-blade members that are formed integrally (for example as by molding) with the shaft so that the inner portion of each blade member is coextensive with an elliptical segment on the respective shaft it is formed on, and subtends the same angles as that of the elliptically-shaped edge portion 86. The blade members of each auger device are stemless and are each slanted for moving developer material longitudinally from a first end to a second end of the auger device. Each device includes a last blade member to which is connected a integrally formed cross-transfer member.

The development apparatus of the present invention includes first and second such auger devices mounted oppositely in an interleaving arrangement in the sump portion of such a development apparatus for providing significant circumferentially intermittent movement of developer material in a longitudinal direction along with substantial longitudinal and radial shearing and mixing of such developer material. As a consequence, the development apparatus of the present invention is substantially reliable and provides significantly improved developer material movement, mixing and charging. It effectively prevents dead spots, uneven depletion of toner particles, and uneven accumulation of developer material therein. The net result is improved image development quality.

The invention has been described in detail with particular reference to a presently preferred embodiment, but it will be understood that variations and modifications can be effected within the spirit and scope of the invention.

What is claimed is:

1. A single piece auger device for use in a development apparatus of an electrostatographic reproduction machine to move, mix and triboelectrically charge developer material, the single piece auger device comprising:

(a) a rigid round shaft having a first end and a second end for mounting in a development apparatus housing;

(b) a plurality of semi-elliptical blade members for moving developer material longitudinally relative to said shaft, said plurality of semi-elliptical blade members being formed integrally with said shaft so as to require no blade-member-to-shaft assembly, said plurality of semi-elliptical blade members including a first blade member adjacent said first end of said shaft, and a last blade member towards said second end of said shaft, and each semi-elliptical blade member of said plurality of blade members extending radially relative to a longitudinal axis of said shaft;

(c) a cross-transfer member for moving developer material radially relative to said shaft, said cross-transfer member being formed connected to, and integrally with, said last blade member, and said cross-transfer member extending longitudinally relative to said shaft from said last blade member to a mounting point adjacent said second end of said shaft so as to eliminate a dead spot in developer material movement from a longitudinal to a radial direction relative to said shaft.

2. The single piece auger device of claim 1 wherein each said blade member of said plurality of said blade members is formed slantingly at an angle of less than 90° with respect to the longitudinal axis of said shaft.

3. The single piece auger device of claim 1 wherein said cross-transfer member is radially coextensive with said last blade member.

4. The single piece auger device of claim 1 wherein each blade member of said plurality of blade members is a stemless semi-elliptical sector having an inside arc and an outside arc connected to said inside arc, and said inside arc being connected directly to said shaft for preventing a dead spot region of developer material adjacent the circumference of said shaft.

5. The single piece auger device of claim 4 wherein said plurality of blade members forms a single longitudinal row of such blade members on said shaft.

6. The single piece auger device of claim 4 wherein said inside arc of each said blade member extends approximately 180° relative to the circumference of said shaft.

7. The single piece auger device of claim 5 wherein said row of said plurality of blade members is straight and aligned circumferentially on said shaft.

8. In an electrostatographic reproduction machine, a development apparatus for developing latent images on an image-bearing member using developer material, the development apparatus including:

(a) an elongate housing having first and second sides, a front end, a back end, and a sump portion for holding, mixing and charging developer material, said sump portion including first and second recessed sections, said first and second recessed sections partially forming an overlapping segment therebetween;

(b) a development roller located so as to be adjacent the image-bearing member for moving charged developer material into applying relationship with electrostatic latent images on such image-bearing member;

(c) feed means between said sump portion and said development roller for feeding charged developer material from said sump portion to said development roller; and (d) rotatable first and second single piece auger devices each mounted respectively in said first and second overlapping recessed sections of said sump for moving developer material therein, each said single piece auger device comprising:

(i) a rigid round shaft having a first end and a second end;

(ii) a plurality of semi-elliptical blade members for moving developer material from one to the other of said front and back ends of the development apparatus housing, said plurality of blade members being formed integrally with said shaft so as to require no blade-member-to-shaft assembly, said plurality of blade members including a first blade member adjacent said first end of said shaft and a last blade member towards said second end of said shaft, each blade member of said plurality of blade members extending radially relative to a longitudinal axis of said shaft; and (iii) a cross-transfer member for moving developer material from one to the other of said first and second sides of said development apparatus housing, said cross-transfer member being formed integrally with, and connected to, said last blade member, and said cross-transfer member extending longitudinally relative to said shaft from said last blade member to a mounting point adjacent said second end of said shaft.

9. The development apparatus of claim 8 wherein said first and second single piece auger devices are mounted oppositely in said development apparatus housing such that said first end of said first auger device is towards said front end of said housing and said second end thereof is towards said back end of said housing, and such that said first end of said second auger device is towards said back end of said housing and said second end thereof is towards said front end of said housing.

10. The development apparatus of claim 9 wherein each said blade member of said plurality of blade members is slanted with respect to the longitudinal axis of said shaft so that said first auger device moves developer material from said front end to said back end of said housing, and from said first side to said second side of said housing at said back end thereof, and so that said second auger device moves developer material from said back end to said front end of said housing, and from said second side to said first side of said housing at said front end thereof.

11. The development apparatus of claim 10 wherein said plurality of blade members of said first and second auger devices, as mounted in said overlapping recessed sections of said sump, are such that the plurality of blade members of the first auger device are staggered with respect to, and interleave with, those of the second auger device.

12. The development apparatus of claim 10 wherein each blade member of said plurality of blade members of each said auger device is a stemless semi-elliptical sector having an inside arc and an outside arc such that said inside arc is connected directly to said shaft of each said auger device for minimizing a dead region of developer material adjacent the circumference of said shaft.

13. The development apparatus of claim 12 wherein said plurality of blade members of each said auger device forms a single longitudinal row of such members on the shaft of each said auger device.

14. The development apparatus of claim 13 wherein said row of said plurality of blade members is straight and is aligned circumferentially with respect to the shaft of each said auger device.

15. The development apparatus of claim 14 wherein said inside arc of each said blade member extends approximately 180° relative to the circumference of the shaft of each said auger device for providing circumferentially intermittent and longitudinal movement of developer material about each said shaft, thereby achieving desirable and substantial longitudinal shearing and mixing of such developer material.

* * * * *